United States Patent [19]

Fijas

[11] 4,154,296

[45] May 15, 1979

[54] INNER FINNED HEAT EXCHANGER TUBE

[75] Inventor: David F. Fijas, Depew, N.Y.

[73] Assignee: American Standard Inc., New York, N.Y.

[21] Appl. No.: 820,963

[22] Filed: Aug. 1, 1977

Related U.S. Application Data

[63] Continuation of Ser. No. 652,610, Jan. 26, 1976, abandoned.

[51] Int. Cl.[2] ..... F28F 1/40

[52] U.S. Cl. ..... 165/179; 165/183; 165/184; 138/38; 29/157.3 H

[58] Field of Search ..... 165/179, 183, 184; 138/38, 108; 29/157.3 H, 157.3 A, 157.3 R

[56] References Cited

U.S. PATENT DOCUMENTS

| | | | |
|---|---|---|---|
| 2,733,908 | 2/1956 | Graham | 165/179 |
| 3,493,041 | 2/1970 | Hourwitz et al. | 165/179 X |
| 3,528,494 | 9/1970 | Levedahl | 165/105 |
| 3,887,004 | 6/1975 | Beck | 165/184 |

FOREIGN PATENT DOCUMENTS

| | | | |
|---|---|---|---|
| 226409 | 7/1959 | Australia | 29/157.3 A |
| 1168929 | 4/1964 | Fed. Rep. of Germany | 165/183 |

*Primary Examiner*—Samuel Scott
*Assistant Examiner*—Theophil W. Streule, Jr.
*Attorney, Agent, or Firm*—James J. Salerno, Jr.; Robert G. Crooks

[57] ABSTRACT

The present invention relates to an inner finned tube particularly suitable for use in a continuous plate-finned heat exchanger. The plate fins are spaced apart along the tube in heat exchange relation therewith. An elongated cylindrical tube is provided with a plurality of integrally formed and radially disposed inner fins projecting toward the axial center line of the tube. Each fin in cross section is formed having a truncated triangular base and a rectangular portion extending toward the axial center line of the tube. The number of equally spaced formed fins is equal to $2\pi/\theta$, where $\theta$ is the angle subtended between the center lines of two adjacent fins and may vary between 0.45 and 0.345 radian. The radial height of each fin may vary between 14 to 20% of the internal diameter of the tube.

2 Claims, 7 Drawing Figures

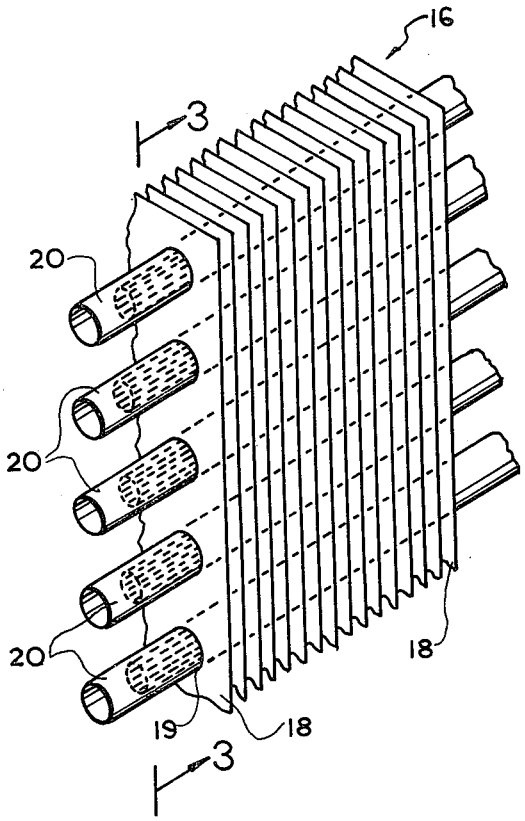
FIG. 2
FIG. 6
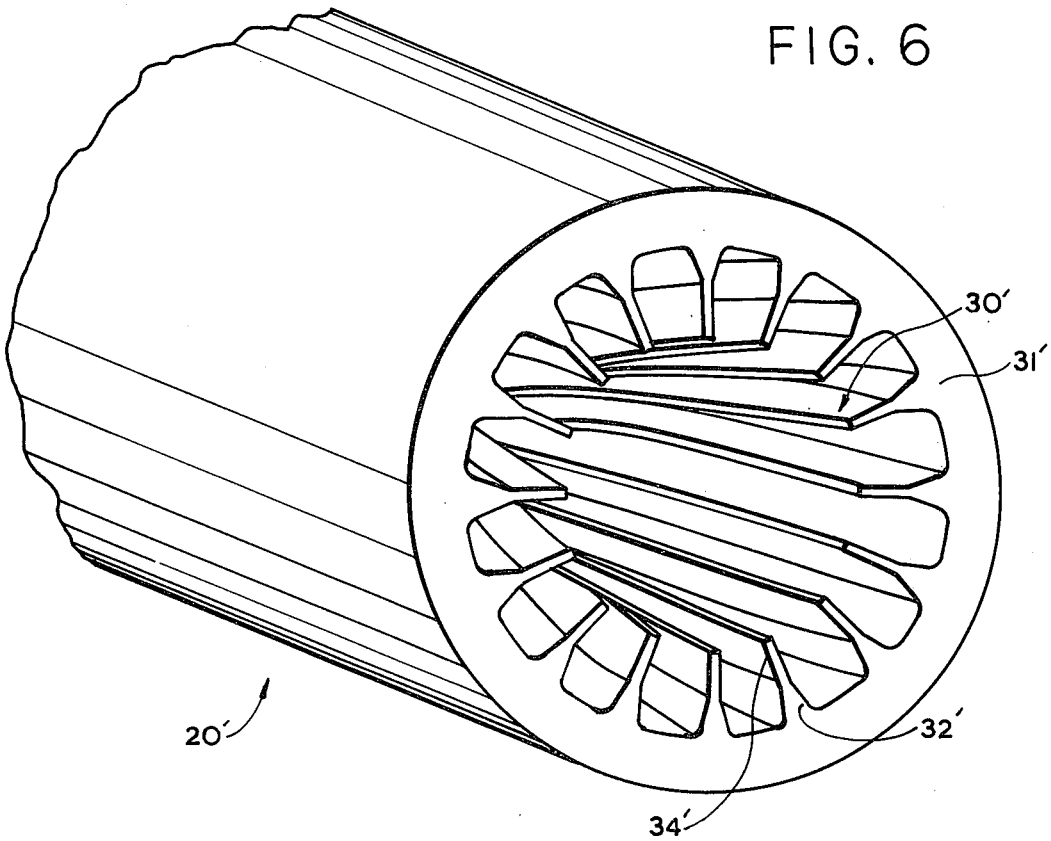

INNER FINNED HEAT EXCHANGER TUBE

This is a continuation of application Ser. No. 652,610, filed Jan. 26, 1976, now abandoned.

BACKGROUND OF THE INVENTION

This invention generally relates to a heat exchanger tube of the inner finned type which is useful in making a heat exchanger coil of the continuous plate finned type for exchanging heat between flowing streams of gas of different temperatures.

Heat exchanger metal tubing of the inner finned type and their method of manufacture are known and have been described in the literature, for example U.S. Pat. No. 3,662,582. An inner finned tube may be formed utilizing brazing or otherwise joining inserted fins into the inner wall of a tube blank. It also may be formed by displacing the material from the wall of the blank into the grooves on a mandrel so that the inner fins are formed integrally with the wall. Such a method decreases the wall thickness of the tube and also causes an elongation of the tube. Other heat exchanger tubing having differing configurations with or without external fins are shown in U.S. Pat. Nos. 3,847,212, 3,273,599, and 3,796,258.

Many other configurations of inner finned or externally finned heat exchanger tubes have been used for specific requirements. However, where two flowing streams of gas are utilized for the exchange of heat it generally requires a heat exchanger coil of relatively large surface area in order to obtain the necessary degree of heat exchange between such gases. To obtain the most compact heat exchange configuration, both the inside and outside tube surfaces must contain fins. Heat exchangers, as is shown in U.S. Pat. No. 3,796,258, which utilize an array of parallel tubes having no internal fins and positioned through continuous plate fins do not increase the internal surface area of the tube.

SUMMARY OF THE INVENTION

It is an object of the present invention to provide a heat exchanger tube of the inner finned type as described above in which the internal fin configuration permits the length of the tube to be decreased while the efficiency of heat transfer is increased between a gas flowing around the outside of the tube and a gas flowing within the tube.

It is another object of the invention to provide a heat exchanger tube which does not adversely affect the pressure drop of the gas flowing through the tube.

Still another object of the invention is to provide a heat exchanger of the continuous plate finned type in which the heat exchanger element comprises an array of internally finned tubes mounted in heat exchange relation with a plurality of continuous plate fins for exchanging heat between a gas flowing around the outside of the tube and a gas flowing within the tube.

A further object of the invention is to provide a more efficient heat exchanger tube of the inner finned type which is relatively inexpensive to manufacture.

The invention generally provides for a heat exchanger tube of the inner finned type which is suitable for use in a continuous plate finned heat exchanger. An elongated, cylindrical tube is provided with a plurality of integrally formed and radially disposed inner fins projecting toward the axial center line of the tube. Each fin in cross section is formed having a truncated triangular base and a rectangular portion extending toward the axial center line of the tube. The number of fins integrally formed in the tube is determined according to the formula $2\pi/\theta$, where $\theta$ is the angle subtended between the center lines of two adjacent fins and may vary between 0.45 and 0.345 radians. The height of each fin may range between about 14 and 20% of the inside diameter of the tube.

The invention also provides for a heat exchanger of the continuous plate fin type for exchanging heat between the gas flowing around the outside of the tube and between the plate fins and a gas flowing within the tube.

BRIEF DESCRIPTION OF THE DRAWINGS

FIG. 2 is an enlarged fragmentary isometric view of a section of the heat exchanger means of the broken away portion of FIG. 1;

FIG. 6 is an enlarged fragmentary isometric view of another form of the tube illustrated in FIG. 4.

BRIEF DESCRIPTION OF THE PREFERRED EMBODIMENTS

Figure 1:
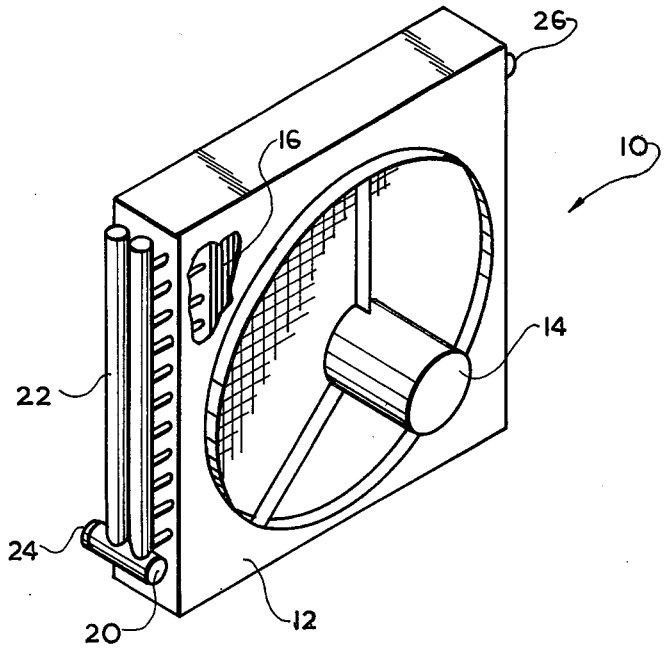
FIG. 1 is an isometric view of the heat exchanger assembly utilizing the invention herein.

Referring now to the drawings wherein like reference characters designate like or corresponding parts throughout the several views. There is illustrated in FIG. 1 a heat exchanger 10 which includes a housing 12, a fan 14 for moving a cooling gas, such as air, through the heat exchanger coil or radiator section 16. Heat exchanger coil 16 is illustrated more clearly in FIGS. 2 and 3 and comprises a plurality of spaced parallel tubes mounted through openings 19 formed in plate fin 18 in heat exchange relation therewith. As illustrated in FIG. 1, parallel tubes 20 are connected to each other through common header 22. At one end of common header 22 is outlet 24 for conducting the cooled gases from heat exchanger coil 16. On the other side of heat exchanger coil 16 and diagonally opposit outlet 24 is inlet opening 26 for conducting gases to be cooled into the heat exchanger coil 16. Not illustrated in FIG. 1 is the means for coupling all of the parallel tubes 20 to complete the circuit for conducting the gases to be cooled through coil 16. Various means may be employed for example utilizing U-bends or a common header similar to header 22.

Figure 3:
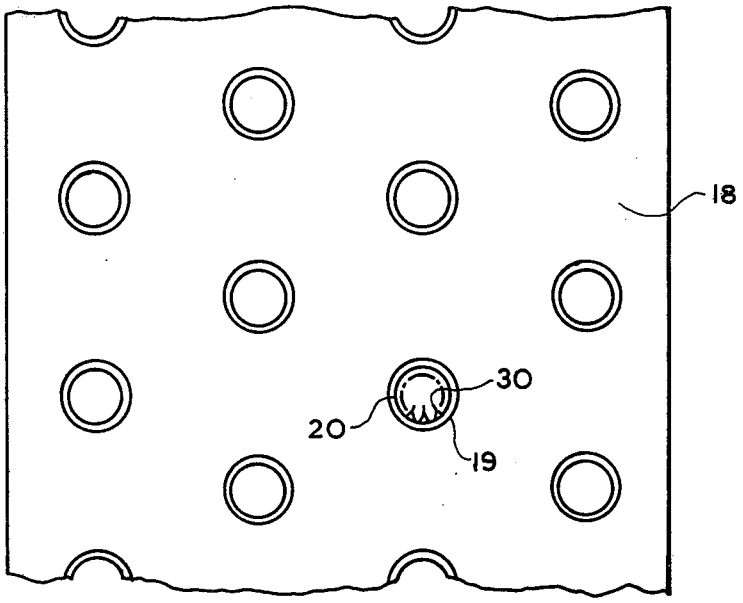
FIG. 3 is a fragmentary sectional view in elevation taken along the line 3—3 of FIG. 2 and particularly illustrates the heat exchange relation between the inner fin tube and the plate fin of the invention herein.

In FIG. 3 a section of a single continuous plate fin 18 is illustrated in which heat exchanger tubes 20 are mounted in spaced relation with each successive row being offset with respect to the adjacent row of spaced tubes so as to form an array of parallel tubes which are interdigitated vertically and horizontally in heat exchange relation with plate fin 18.

FIGS. 2 and 3 illustrate an enlarged section of heat exchanger coil 16 shown broken away in FIG. 1. A vertical row of spaced parallel tubes 20 are shown mounted in plate fins 18 through aligned openings 19 in each plate fin 18. Tubes 20 and plate fins 18 are mounted in heat exchange relation. This may be accomplished by known processes as by soldering the plate fin to the outer surface of the tube such as described in U.S. Pat. No. 3,613,588. Also, where the plate fin is corrugated the fin may be mounted as described in U.S. Pat. No. 3,847,213. Another method employed is to first position all plate fins on the tubes as shown in FIGS. 2 and 3; then the tubes are connected to a hydraulic circuit and are subjected to hydraulic pressure to hydraulically expand the tubes so that the plate fins form a compressive fit with the tube in heat exchange relation. Such a method is suitable where the tubes are internally finned to avoid damage to the formed fins. Where the tubes are not internally finned a slightly oversized mandrel may be rammed through each tube to provide a compressive fit between the fin and tubes.

Figure 4:
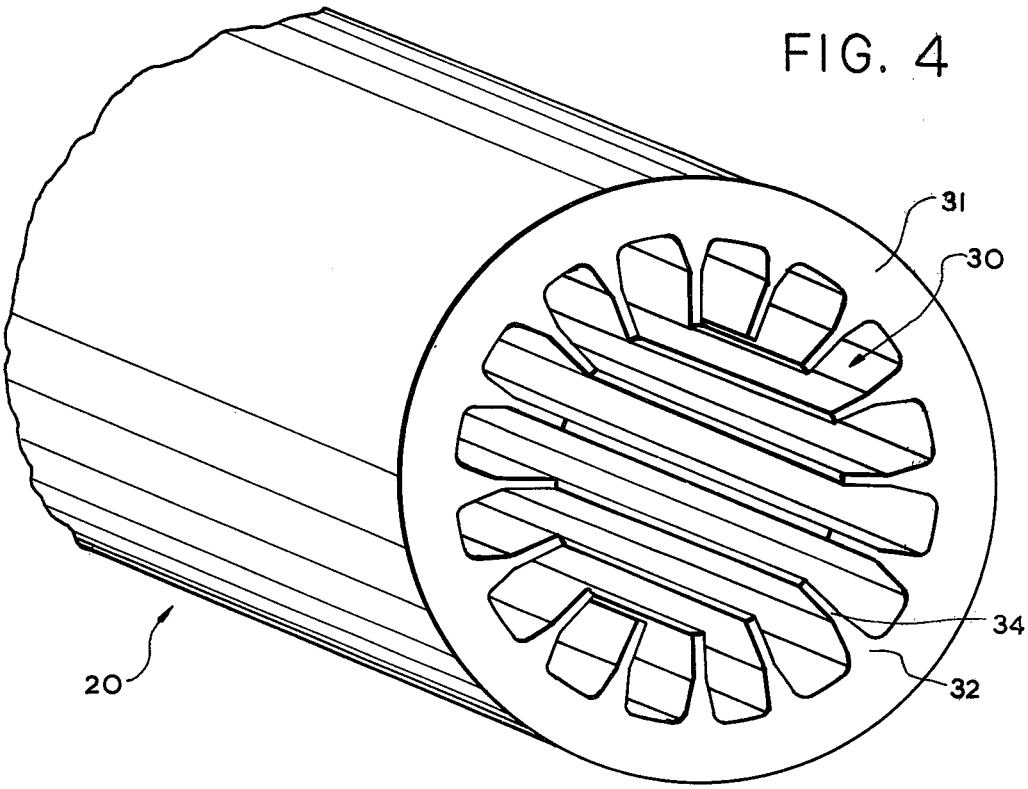
FIG. 4 is an enlarged fragmentary isometric view of one of the heat exchanger tubes.

FIGS. 4 and 6 show an enlarged isometric section of two internally finned tubes embodying the invention herein. The geometrically shaped internal fins 30, 30' of FIGS. 4 and 6 are integrally formed from wall 31, 31' preferably by drawing a tube blank over a mandrel as herein before discussed. The base section 32, 32' of internal fins 30, 30', when viewed in cross section as seen in FIGS. 4 and 6, are triangular with the apex removed giving the appearance of a truncated triangle. The upper section of fins 30, 30' are rectangularly shaped in cross section with each fin extending toward the axial center line of tubes 20, 20'. The fins 30 of FIG. 4 are preferably uniformly spaced from each other, are parallel to each other and extend toward the axial center line of tube 20.

Figure 7:
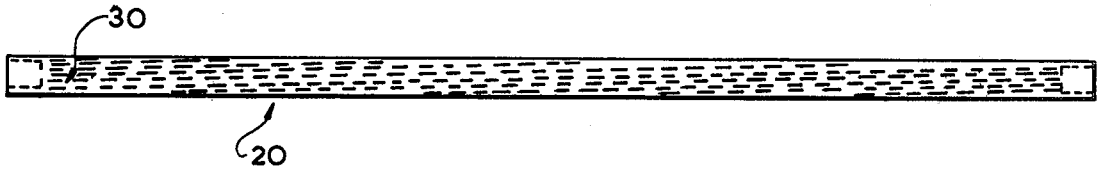
FIG. 7 is a side elevational view of the tube of FIG. 6.

In FIG. 6 fins 30' are also uniformly spaced and are parallel to each other, however the fins form a spiral of approximately one inch in 24 inches of tube length. This is illustrated in dotted lines in FIG. 7. The fins also extend toward the axial center line of the tube.

Figure 5:
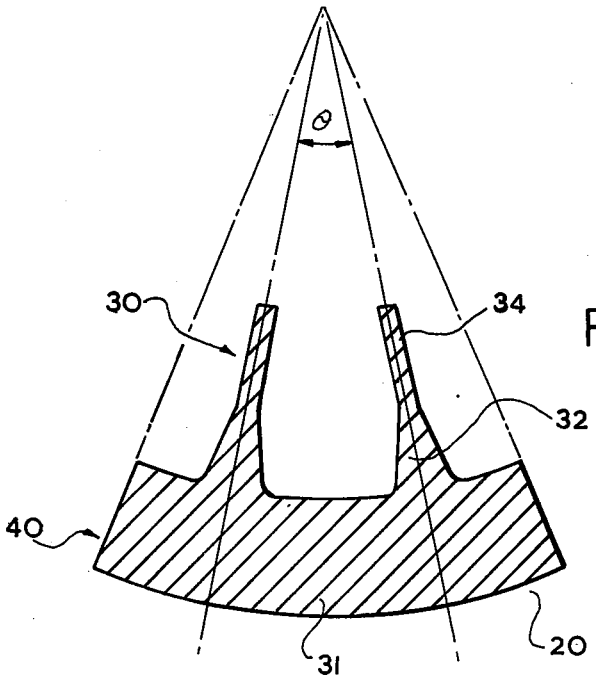
FIG. 5 is an enlarged detailed segment of the heat exchanger tube of FIG. 4.

FIG. 5 illustrates an enlarged detailed segment 40 of heat exchanger tube 20 of FIG. 4. The number of fins 30 of tube 20 is determined according to the formula $2\pi/\theta$; the angle $\theta$, being calculated in radians, is illustrated by extending the center lines of two adjacent fins 20 through the axial center of the tube. The angle $\theta$ may vary between 0.45 and 0.345 radian. Thus where $\theta$ is 0.45 radian the number of internal fins is 14. Where $\theta$ is 0.345 radian the number of internal fins is 18.

As indicated above, it is preferred to shape fins 30 by drawing a tube blank over a suitably shaped mandrel so that fins 30 are formed integrally with wall 31 of tube 20. It has been found that as the length of the fin is increased and gets closer to the axial center of the tube the greater the efficiency of heat transfer for a gas is achieved. However, since the fins are formed integrally with wall 31, the mass of each fin diminishes and uniformity of its configuration is lost. Also, if the height extended to axial center of the tube, the tube would have an increase in pressure drop, requiring an increased amount of energy to be used, and the tube would be more difficult to clean.

It has been found that the preferred inner fin tube, to provide optimum heat transfer, minimum pressure drop and uniformity of configuration occurs when the fins herein have a height of between 14 and 20% of the internal diameter of the tube.

For a better understanding of the invention herein, a heat exchanger 10 of the type described in FIG. 1 was employed to cool heated compressed air. The heat exchanger coil is made up of 56 copper tubes 18.5 inches long, each tube having an average wall thickness of 0.030 inch, an outside diameter of 0.375 inch, and an internal diameter of 0.315 inch with 16 internal fins having an average height of 0.047 inch which are uniformly spaced at 0.393 radian and integrally formed from the tube wall with the fins being parallel to the axial center line of the tube and each fin extending toward the center line of the tube. The continuous plate fins are mounted on the tubes as shown in FIG. 2, and are equally spaced at 12 fins per inch of tube length. The fins are mechanically bonded to the outer walls of the tubes in heat exchange relation by hydraulically pressurizing the inside of the tubes to expand the tube above the yield point. The heat exchanger coil when completed is a two pass coil utilizing "U" bends to complete each circuit.

Compressed air having an inlet temperature of 300° F. was conducted through inlet opening 26 at a rate of 160 CFM, 35 psig pressure and circulated through heat exchanger coil 16. The compressed air is conducted through the heat exchanger coil at a pressure drop of 1.35 psig between the inlet and outlet openings of the coil. The coolant gas air, at 75° F., was blown across heat exchanger coil 16 at a rate of 1800 CFM by the fan mounted on the heat exchanger. Heat from the compressed gas is conducted to the inner fins, through the tube wall and along the plate fins and is transferred to the coolant air so that the temperature of the compressed air is reduced to 105° F.

A heat exchanger of similar design as described above was employed to compare the difference in heat transfer when using a coil design identical in every respect except that each tube had a smooth internal bore rather than the inner finned tubes according to the present invention.

When hot compressed air at 300° F., 160 CFM at a pressure of 35 psig was circulated through the coil, the compressed air was cooled to only 145° F. by air at 75° F. blown across the heat exchanger coil at a rate of 1800 CFM.

In order to cool 160 CFM of hot compressed air from 300° F. to 105° F., the heat exchanger coil of the smooth internal bore type must be increased in size to include 88 smooth internal bore copper tubes, each tube being 28½ inches long and would require 2600 CFM of coolant air at 75° F. Thus, for the same heat transfer performance, the coil with the smooth internal bore tube type would require a tube length equal to 242% of the tube length in the heat exchanger coil utilizing the inner finned tubes of the present invention.

From the foregoing description of the invention, it is apparent that the heat exchange tube may vary in design and that the form of heat exchangers may vary in structure and materials without departing from the teachings herein.

What is claimed is:

1. In a heat exchanger that improvement comprising a metal tube of the internal finned type comprising:

an elongated, cylindrical tube open at both ends and having a plurality of integrally formed internal fins of uniform height, said fins being uniformally spaced and radially disposed and projecting toward the axial center line of the tube;

each fin being formed integrally from the wall of said tube and extending longitudinally along and throughout the extent of the inner wall surface of said tube and being parallel to the axial center of said tube;

each fin being of uniform cross-section throughout the effective length of said tube and having a configuration of a truncated triangular base formed integrally with the wall of the tube forming a truncated triangle in cross-section with the apex removed, and a rectangular portion in cross-section formed integrally with and centrally of the truncated triangle extending toward the axial center line of the tube;

the number of fins being equal to the formula $2\pi/\theta$ where $\theta$ in radians is the angle subtended between the center lines of two adjacent fins and may vary between 0.45 and 0.345 radian and the fin height being between 14% and 20% of the internal diameter of the tube, whereby the fins are widely separated to provide a plurality of wide channels therebetween and thus maintain a large free open area within the tube, resulting in maximum heat transfer while maintaining a relatively low pressure drop.

2. The heat exchanger tube of claim 1 wherein the fins form a spiral of approximately one inch for every 24 inches of tube length, said spiral fins being parallel to each other.

* * * * *